United States Patent [19]

Dippert

[11] Patent Number: 4,594,647

[45] Date of Patent: Jun. 10, 1986

[54] ADJUSTABLE LIGHT

[76] Inventor: Louis A. Dippert, 1034 Philadelphia St., Rapid City, S. Dak. 57701

[21] Appl. No.: 677,060

[22] Filed: Nov. 30, 1984

[51] Int. Cl.[4] ..... F21V 15/00

[52] U.S. Cl. ..... 362/376; 362/282; 362/344

[58] Field of Search ..... 362/376, 377, 378, 269, 362/273, 274, 282, 306, 109, 396, 400, 399, 344, 347

[56] References Cited

U.S. PATENT DOCUMENTS

| | | | |
|---|---|---|---|
| 1,692,892 | 11/1928 | Floyd | 362/378 |
| 2,318,329 | 5/1943 | Popp | 362/344 |
| 2,460,173 | 1/1949 | Halbing | 362/376 |
| 2,478,010 | 8/1949 | Popp et al. | 362/376 |
| 2,510,001 | 5/1950 | Van Duzer | 362/344 |
| 2,554,565 | 5/1951 | Fike | 362/400 |
| 2,602,880 | 7/1952 | Engelhardt et al. | 362/396 |
| 2,608,643 | 8/1952 | Day | 362/344 |
| 3,244,873 | 4/1966 | Leutheuser | 362/376 |
| 3,755,668 | 8/1973 | Moreschini | 362/282 |

*Primary Examiner*—Magdalen Y. C. Greenlief
*Attorney, Agent, or Firm*—Richard L. Miller

[57] ABSTRACT

A trouble light is provided and consists of a reflector adjustably supported around an electric light socket for an electric light bulb with a guard to provide illumination, a device for turning the reflector around the socket in 360° to direct the illumination from the bulb in any direction therefrom and a friction spring for holding the reflector in position after the reflector is turned. The guard is multi-sided so that it does not roll when laid down to rest.

5 Claims, 6 Drawing Figures

ADJUSTABLE LIGHT

BACKGROUND OF THE INVENTION

The instant invention relates generally to trouble lights and more specifically it relates to a trouble light that has a rotatable reflector to adjust the light in any direction therefrom.

Numerous trouble lights have been provided in prior art that are adapted to turn with respect to their support devices. For example, U.S. Pat. No. 2,861,175; 2,987,612 and 3,814,927 all are illustrative of such prior art. While these units may be suitable for the particular purpose to which they address, they would not be as suitable for the purposes of the present invention as heretofore described.

SUMMARY OF THE INVENTION

A principle object of the present invention is to provide a trouble light with a rotatable reflector having an adjustment knob independent from the hook.

Another object is to provide a trouble light that has a friction spring to hold the reflector in any desired position after the reflector is rotated.

An additional object is to provide a trouble light that has a flat multi-sided guard which does not easily roll when laid down to rest.

A further object is to provide a trouble light that is economical in cost to manufacture.

A still further object is to provide a trouble light that is durable to withstand heat and prolonged usage.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
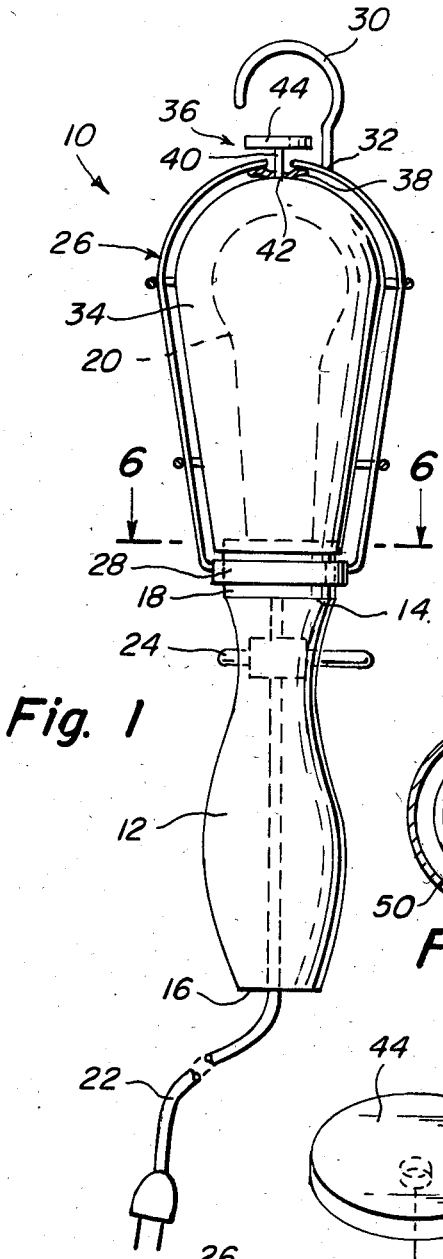
FIG. 1 is an elevational view of the invention with parts broken away.
Figure 2:
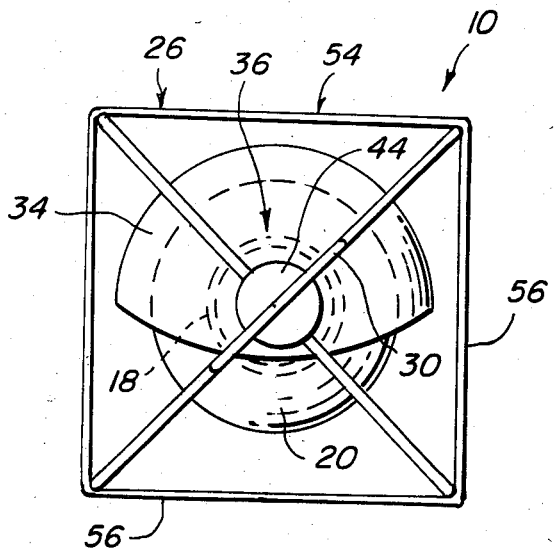
FIG. 2 is an enlarged top end plan view thereof showing the frame being four sided.

Turning now descriptively to the drawings in which similar reference characters denote similar elements throughout the several views, FIGS. 1 and 2 illustrate a trouble light 10 containing an elongated handle member 12 that has a pair of opposed ends 14 and 16. An electric light socket 18 is provided for an electric light bulb 20 to produce illumination. The socket 18 is fixedly secured to one end 14 of the handle 12. An extension cord 22 extends through other end 16 of the handle 12 for connecting the socket 18 to a power supply. A switch 24 can also be placed into the handle 12 to turn the bulb 20 on and off.

Figure 5:
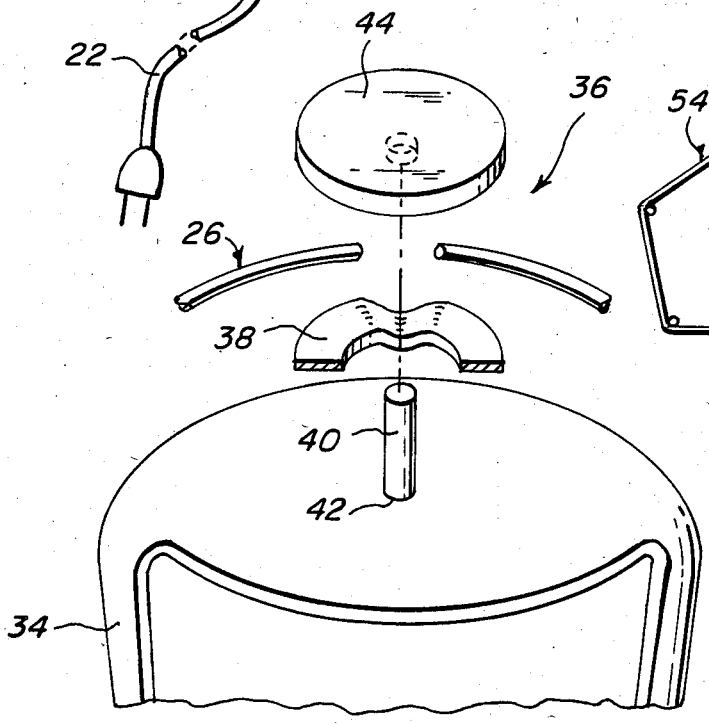
FIG. 5 is an enlarged exploded perspective view with parts broken away showing the adjustment knob and friction spring in greater detail.

A guard 26 is secured to the socket 18 by a guard clamp 28 to surround and protect the light bulb 20. A hook 30 is attached to top of the guard 26 at 32 for supporting same in a balanced hanging relationship. A reflector 34 is adjustably supported around the socket 18 within the guard 26. As best seen in FIG. 5, a device 36 is provided for turning the reflector 34 around the socket 18 in 360° to direct the illumination from the bulb 20 in any direction therefrom.

A wave washer spring 38 is for holding the reflector 31 in position after the reflector is turned. The device 36 consists of a shaft 40 attached to top center of the reflector at 42 and extends outwardly from the guard 26. A knob 44 is affixed to free end of the shaft 40 so that the reflector 34 can be manually turned. The wave washer spring 38 is positioned on the shaft 40 between the reflector 34 and the guard 26 causing friction when the knob 44 is turned.

Figure 6:
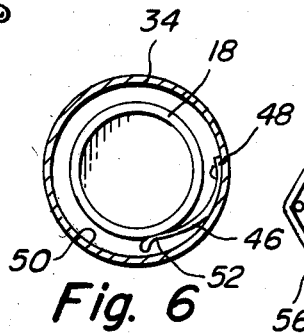
FIG. 6 is a cross sectional view taken along line 6—6 in FIG. 1 showing another type of friction spring.
Figure 3:
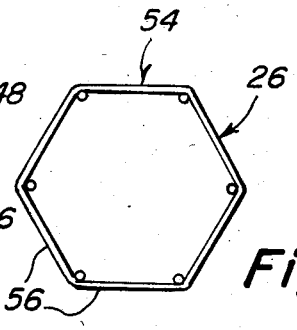
FIG. 3 is a similar top end plan view illustrating an embodiment with a six sided frame.
Figure 4:
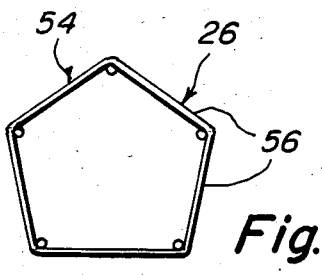
FIG. 4 is another similar top plan view illustrating an embodiment with a five sided frame.

FIG. 6 shows another way for holding the reflector 34 in position after the reflector is turned. It is a flat spring 46 mounted at one end 48 to bottom inner surface 50 of the reflector 34 adjacent the socket 18 so that other end 52 of the flat spring 46 will drag on the socket. As best seen in FIGS. 2 through 4, the guard 26 is a cage frame 54 that has flat multi-sides 56 which does not roll when laid down to rest. FIG. 2 shows the cage frame 54 as four sided, FIG. 3 as six sided and FIG. 4 as five sided. Other geometric patterns (not shown) can also be used to provide the above results.

The reflector 34 is a big improvement over standard trouble lights as they can seldom be directed where light is needed without holding it by hand. The trouble light 10 should not cost much more than standard trouble lights to manufacture. It can be sold with cord 22 complete or just the reflector 24 and guard 26 to fit most conventional trouble lights.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is :

1. A trouble light which comprises:

(a) an elongated handle member having a pair of opposed ends;

(b) an electric light socket for an electric light bulb to provide illumination, said socket being fixedly secured to one end of said handle;

(c) an extension cord extending through the other end of said handle for connecting said socket to a power supply;

(d) a guard secured to said socket to surround and protect said light bulb;

(e) a hook attached to the top of said guard for supporting same in a balanced hanging relationship;

(f) a reflector having a portion partially surrounding the light bulb adjustably supported around said socket within said guard and including a lower portion completely encircling said light socket;

(g) means for turning said reflector around said socket in 360° to direct said illumination from said bulb in any direction therefrom including a shaft attached to the top center of said reflector and extending outwardly from said guard and a knob affixed to the free end of said shaft so that said reflector can be manually turned; and (h) means for holding said reflector in position after said reflector is turned, comprising a wave washer spring positioned on said shaft between said reflector and said guard causing friction when said knob is turned, and a flat spring mounted at one end to the inner surface of said lower portion of the reflector so that the other end of said flat spring will drag on said socket causing friction when said knob is turned, and whereby said reflector will be stabilized both as it moves and when it is stationary.

2. A trouble light as recited in claim 1 wherein said guard is a cage frame having flat multi-sides which does not roll when laid down to rest.

3. A trouble light as recited in claim 2 wherein said cage frame is four sided.

4. A trouble light as recited in claim 2 wherein said cage frame is five sided.

5. A trouble light as recited in claim 2 wherein said cage frame is six sided.

* * * * *